US012144406B2

(12) United States Patent
Decker

(10) Patent No.: US 12,144,406 B2
(45) Date of Patent: Nov. 19, 2024

(54) JEWELRY CLASP

(71) Applicants: Pandora A/S, Copenhagen (DK); Pandora Production Co., Ltd., Bangkok (TH)

(72) Inventor: John R. Decker, South Holland,, IL (US)

(73) Assignees: Pandora A/S, København V (DK); Pandora Production Co., Ltd., Bangkok (TH)

( * ) Notice: Subject to any disclaimer, the term of this patent is extended or adjusted under 35 U.S.C. 154(b) by 53 days.

(21) Appl. No.: 17/997,122

(22) PCT Filed: Mar. 29, 2021

(86) PCT No.: PCT/EP2021/058212

§ 371 (c)(1),
(2) Date: Oct. 25, 2022

(87) PCT Pub. No.: WO2021/223941

PCT Pub. Date: Nov. 11, 2021

(65) Prior Publication Data

US 2023/0263275 A1 Aug. 24, 2023

(30) Foreign Application Priority Data

May 6, 2020 (EP) ..... 20173213

(51) Int. Cl.
*A44C 5/20* (2006.01)

(52) U.S. Cl.
CPC ..... *A44C 5/2071* (2013.01); *A44D 2203/00* (2013.01); *A44D 2211/02* (2013.01)

(58) Field of Classification Search
CPC ..... A44C 5/2071; A44D 2211/02; A44D 2203/00; A44B 11/258; A44B 11/2523
See application file for complete search history.

(56) References Cited

U.S. PATENT DOCUMENTS 5,050,276 A 9/1991 Pemberton
5,377,392 A * 1/1995 Morita ..... A45C 13/1069 24/303

(Continued)

FOREIGN PATENT DOCUMENTS

CH 255179 A 6/1948
CN 205512790 U 8/2016

(Continued)

*Primary Examiner* — Robert Sandy
(74) *Attorney, Agent, or Firm* — AVEK IP, LLC

(57) ABSTRACT

A jewelry clasp includes respective first and second clasp parts and a slider. At least part of the first clasp part in an attached position thereof is received in a housing of the second clasp part. At least one of the first and second clasp parts includes a magnet, and the other of the first and second parts includes a part magnetically attractable by the magnet so that the first clasp part in its attached position is held to the second clasp part by magnetic attraction. The slider is attached to and slideable in relation to the housing of the second clasp part, and is slideable between a releasing state and a locking state. In the releasing state, the first clasp part may be detached from the second clasp part, and in the locking state the first clasp part is prevented from being detached from the second clasp part.

19 Claims, 7 Drawing Sheets

(56) References Cited

U.S. PATENT DOCUMENTS

| | | | | |
|---|---|---|---|---|
| 5,722,260 | A | 3/1998 | Mangano | |
| 5,937,487 | A * | 8/1999 | Bauer | A41F 1/002 24/66.1 |
| 6,131,247 | A * | 10/2000 | Morita | A45C 13/1069 24/303 |
| 6,295,702 | B1 * | 10/2001 | Bauer | A45C 13/1069 24/303 |
| 6,564,434 | B1 * | 5/2003 | Morita | A45C 13/1069 24/114.2 |
| 6,598,271 | B2 | 7/2003 | Nire | |
| 9,101,185 | B1 | 8/2015 | Greenberg | |
| 10,376,022 | B2 | 8/2019 | Duncan et al. | |
| 11,647,815 | B2 * | 5/2023 | Weng | A44B 19/301 24/303 |
| 2002/0112323 | A1 | 8/2002 | Nire | |
| 2014/0000068 | A1 | 1/2014 | Casini | |
| 2015/0216269 | A1 | 8/2015 | Fuhrman et al. | |
| 2015/0359301 | A1 | 12/2015 | Lavorato et al. | |
| 2016/0058136 | A1 | 3/2016 | Ng | |
| 2016/0316839 | A1 | 11/2016 | King | |
| 2017/0354212 | A1 | 12/2017 | Harazim et al. | |
| 2019/0357641 | A1 | 11/2019 | Duncan et al. | |

FOREIGN PATENT DOCUMENTS

| | | | |
|---|---|---|---|
| CN | 206413863 | U | 8/2017 |
| CN | 206760948 | U | 12/2017 |
| CN | 207506048 | U | 6/2018 |
| DE | 439480 | C | 1/1927 |
| DE | 202012103179 | U1 | 9/2012 |
| DE | 102012007259 | A1 | 10/2013 |
| DE | 102016100631 | B4 | 8/2019 |
| DE | 202019003328 | U1 | 9/2019 |
| EP | 3142511 | B1 | 7/2018 |
| EP | 3166437 | B1 | 2/2019 |
| ES | 1064132 | U | 5/2007 |
| FR | 2418632 | A1 | 9/1979 |
| JP | H09238721 | A | 9/1997 |
| JP | H11235220 | A | 8/1999 |
| WO | 2012117577 | A1 | 9/2012 |

* cited by examiner

JEWELRY CLASP

CROSS-REFERENCE TO RELATED APPLICATIONS

This application is the national phase of, and claims priority to, International Application No. PCT/EP2021/058212, filed Mar. 29, 2021, which claims priority to European Application No. 20173213.8, filed May 6, 2020, the disclosure of each of which is incorporated by reference herein in its entirety.

FIELD OF THE INVENTION

The invention relates to jewelry clasps for securing a first end of an elongated member of a bracelet or a necklace to a second end of the elongated member.

BACKGROUND

Jewelry, such as bracelets and necklaces, traditionally comprises ornamental components, e.g. beads or charms, strung on one or more elongated members. An elongated member may be a chain, wire, string, thread, chord, or the like. Such bead-carrying jewelry has been known since antiquity. Ends of the elongated member are traditionally attached together permanently to prevent the one or more beads from falling off. However, when worn by a user today, the ends of an elongated member of modern jewelry are typically temporarily attached to each other by means of a jewelry clasp. Such jewelry clasps are commonly used in bracelets and necklaces.

With some prior art jewelry clasps, locking and unlocking the jewelry clasp without requiring the assistance of a second person may be difficult. This may especially be the case for bracelets worn on the wrist since this often leaves only the other hand for engaging the jewelry clasp, but this may also be perceived as a problem in other types of jewelry, such as necklaces. Therefore, some users prefer jewelry clasps that may easily be locked and unlocked using only one hand without imposing a risk for accidental separation of the ends of the piece of jewelry when the jewelry is worn.

Some prior art jewelry clasps include magnets for providing or assisting in the releasable attachment of the ends of the elongated members to each other. The magnetic forces keeping the ends together may be relatively weak which has prompted the provision of mechanical safety latches which are typically activated after attachment of a magnetic lock.

An example of a prior art jewelry clasp including a magnetic lock and a mechanical latch is disclosed in U.S. Pat. No. 5,050,276 A. Magnets of the magnetic lock are moved in an axial direction along an axis of the clasp to assume a position in abutment with each other. A hinged latch attached to one of the ends of one clasp half is pivoted to lock two clasp halves together.

Another example, WO 2012/117577 A1, discloses magnets and a spring-engaged lock.

Objects of the jewelry clasps and jewelry according to the invention may involve one or more of enabling an easier activation of the clasp parts and/or an easier release of the clasp, potentially with one hand only, and more secure or safer attachment of ends of an elongated member. Other objects may involve improved control of the clasps during their activation and release, as well as avoiding damage of fingernails during release of the clasp.

SUMMARY

A first aspect of the invention involves a jewelry clasp for securing a first end of an elongated member of a bracelet or a necklace to a second end of the elongated member. The jewelry clasp includes a first clasp part and a second clasp part. At least part of the first clasp part in an attached position thereof is positioned received in a housing of the second clasp part. At least one of the first and second clasp parts includes a magnet and the other of the first and second parts comprising a part magnetically attractable by the magnet so that the first clasp part in its attached position is held to the second clasp part by magnetic attraction. The jewelry clasp further includes a slider attached to and slideable in relation to the housing of the second clasp part. The slider is slideable between a releasing state and a locking state, the slider in the releasing state allowing for the first clasp part to be detached from the second clasp part, the slider in the locking state preventing the first clasp part from being detached from the second clasp part.

Hereby, the magnet and the part magnetically attractable by the magnet may provide an initial attachment of the first and second clasp parts. This magnetic lock may be easily activated by one hand, simply by bringing the first and second clasp parts close together, whereby the magnetic attraction will help proper mutual positioning of the clasp parts. Subsequently, the slider may be slid to the locking state to provide a safety lock which may ensure that the clasp parts are not accidentally released from each other. The slider may also be easy to activate by one hand. Similarly, when releasing the clasp parts from each other, the slider may readily be slid to return to its releasing state after which the magnets may continue to keep the two clasp parts together, and the wearer of the jewelry can separate the two clasp parts in a controlled manner. If slideable beads or charms are strung on, for example, a bracelet comprising the clasp, it may be possible to better control detachment of the bracelet or necklace so that the beads or charms do not fall off.

Compared to, for example, a hinged safety latch, the slider can be made more durable and easier to operate. Also, in the releasing state of the slider, less or no parts of the slider may project in a radial direction, making the slider less likely to, for example, be bent by accident.

Furthermore, the design involving a slider allows for a range of possibly advantages embodiments which will be described in the following.

A sliding movement of the slider may be linear or a linear movement and/or a shifting movement. The sliding movement of the slider may not include a rotating or pivoting movement. The sliding movement may occur in an axial and/or length direction of the jewelry clasp and/or of the elongated member to be attached to the jewelry clasp. The axial direction may be a longitudinal direction and may extend in a length direction of the elongated member. The axial direction may extend between the two ends of the elongated member. The axial direction or length or longitudinal direction may be defined as a direction of the sliding movement of the slider.

The housing may include a clasp shell. The housing or the clasp shell may enclose a spacing in which at least part of the first clasp part, such as the head part described below, is positioned in its attached position.

The slider may in the releasing state allow for the first clasp part to be detached from the second clasp part when a force exerted on the first clasp part overcomes at least the magnetic attraction between the magnet and the magnetically attractable part.

The housing may include all parts of the second clasp part except for the slider.

The housing may comprise an opening through which the first clasp part is inserted when the first clasp part is moved to its attached position. The opening may lead into a spacing of the housing for receiving the first clasp part.

The housing may include a spacing corresponding to or matching the or a magnet, the magnet being positioned in the spacing, potentially attached thereto, potentially by means of glue.

The magnet(s) may have a cylindrical shape.

The housing may be a first half of the second clasp part, and the slider may be a second half of the second clasp part.

The housing and the slider may, at least in the locking state of the slider, i.e., a closed or locked position of the second clasp part, together form a cylindrical shape of the second clasp part. The housing may form a first half of the cylinder, and the slider may form a second half of the cylinder. Other shapes, such as spherical, parallelepipedal, or heart-shaped, of the closed clasp are also possible.

The slider may comprise a radially and/or outwardly extending grip projection, which may make it easier to grip the slider by a finger when sliding the slider between the locking and releasing states. The grip projection may extend along at least a part of a perimeter of the slider. The grip projection may be formed as a groove and may comprise an engraving.

The jewelry clasps according to the invention may be used in any suitable piece of jewelry, such as a bracelet or necklace. A bracelet may be defined as a piece of jewelry that is typically worn on the wrist of a user (a wrist bracelet), typically at least partly surrounding the wrist. A bracelet may also be worn on the ankle (an ankle bracelet or "anklet"), whereas a necklace is typically worn on the neck of a user.

The jewelry clasps of the invention may comprise or consist of metal, e.g. silver, iron, gold, brass, or alloys thereof, such as steel, plastic, plastic polymers, glass, precious stones or gemstones, wood, and ornamentations. The jewelry clasps may be intended to be hidden while worn or to form a key element in the design of the jewelry.

The housing may be a casing and/or may comprise a clasp shell and/or a circumferentially extending outer wall, which may define a spacing for receiving the part of the first clasp part that in its attached position is inserted in the housing. A shape of the housing or the clasp shell and the slider in its locking state may together form a substantially round and/or spherical, parallelepipedal, ellipsoidal, cylindrical or any other suitable shape. The housing may be made of a hard and/or rigid and/or solid and/or robust material. The two clasp parts may comprise or consist of metal, such as silver, iron, gold, brass, or a metal alloy, potentially including one or more of these, such as steel or a silver alloy, a plastic or plastic polymer material, glass, precious stone or gemstone, wood, or any other suitable material. The two clasp parts may be coated or plated, such as gold-plated. The two clasp parts may comprise a pattern at an exterior surface of the parts, such as streaks extending in a diagonal, axial, or perpendicular direction with regards to the axial direction. These streaks may form a pattern corresponding to a pattern of the elongated member. The elongated member may be a snake chain, in which case the pattern of the clasp parts may be a snake chain pattern. The two clasp parts may further comprise an engraving. The housing may comprise a substantially annularly and/or cylindrically shaped outer wall. The housing may be in one piece and/or integrally shaped, potentially having comprising annular wall sections. Similarly, the slider and the first clasp part may be in one piece. The housing may comprise an exterior and/or an interior surface.

The housing of the invention may enclose a spacing and may, together with the slider in its locking state enclose a substantially closed spacing, potentially with an opening in an axial end wall of the housing for receiving a part, potentially a neck part, of the first clasp part and providing communication between the enclosed spacing and the surroundings. The spacing may be located at one end of the clasp or throughout the housing.

The housing may enclose, encase, or house a spring and potentially part of a spring-biased element and/or a or the magnet.

The clasp shells of the invention may comprise a top, a bottom positioned oppositely from the top, a first side, and a second side, each of the first and second sides connecting the top and bottom. The first and the second side may be positioned oppositely from each other.

The housing may comprise a first opening and a second opening. The first opening may be positioned at or in a first axial end wall of the housing. The first clasp part may be received or be receivable in the first opening. The second opening may be positioned in an opposed axial end wall of the housing and may be for receiving an end of an elongated member of a piece of jewelry.

The jewelry clasps of the invention may comprise one or more magnets exerting a magnetic force. A magnet may be defined as a material or object that produces a magnetic field. The magnet may be a permanent magnet. A magnet may be positioned in a cut-out in an internal surface of the housing, the cut-out potentially being positioned oppositely to the first opening of the housing. The magnet may at one end or pole abut the clasp shell and/or at another end or pole abut the first clasp part in its attached position.

The magnet may be configured to magnetically attract a second magnet and/or a ferromagnetic member and/or a magnetically attractable material. The magnet may alternatively be located in, or another magnet may be located in, the first clasp part.

The first clasp part may be brought to its attached position by the attraction between the magnet and the magnetically attractable material or by the opposite polarity between two magnets.

When the slider is in its releasing state, the first clasp part may be extractable from the jewelry clasp by pulling it or part of it out of the housing, overcoming the magnetic attraction.

The one or more magnets of the jewelry clasps of the invention may have a cylindrical, annular, conical, spherical and/or parallelepipedal shape. The magnets may include several sub-magnets, e.g., a linked series of sub-magnets and/or ferrous beads. One or more of the magnets may have a width that is substantially equal to a length of the magnet. One or more of the magnets may consist of or comprise neodymium.

One or more of the magnets may be at least partly included or embedded in the housing and/or in the first clasp part. One or more of the magnets may be positioned, potentially attached, in a cut-out in an interior surface of the housing.

The elongated member may be or comprise a chain, such as a snake chain, wire, string, thread, chord, or the like. The elongated member may be a snake chain. The snake chain may comprise round, wavy, and/or smooth metal links that are joined to form a flexible chain. The elongated member may comprise or consist of one or more of the materials mentioned above. The elongated member may also be coated or plated, such as gold-plated. The elongated member, in particular an intermediate part thereof, may be flexible and/or elastic and/or resilient. The elongated member may be cylindrical and/or rigid and/or hollow. The elongated member may be flat and/or may be a strap-shaped member. The elongated member may include or consist of interconnected or hinged joints, potentially chain joints.

The first clasp part may comprise a cap that is positioned to receive and attach an end of the elongated member, which may further comprise an intermediate, potentially flexible, part leading to a second end of the elongated member. The cap may have a conical, frusto-conical, annular, spherical, cylindrical and/or parallelepipedal shape. The first end or tip part may have a truncated conical or shape. The cap may be defined by or be positioned adjacent to a neck part of the first clasp member, the neck part potentially connecting the cap to a head part of the first clasp part.

A second end of the elongated member positioned at an opposite end of the elongated member may be in one piece or integral with the housing or may be fixedly and/or permanently mounted in or to the housing. The second end may include or may be a cap, which may be integral with or may be fixed or attached to a flexible intermediate part of the elongated member. The second end of the elongated member may be inserted in and/or be mounted in an opening of the housing and may potentially extend from the opening into the spacing of the clasp shell.

Furthermore, the design involving a slider allows for a range of possibly advantages embodiments which will be described in the following.

A sliding movement of the slider may be linear or a linear movement and/or a shifting movement. The sliding movement of the slider may not include a rotating or pivoting movement. The sliding movement may occur in an axial and/or length direction of the jewelry clasp and/or of the elongated member to be attached to the jewelry clasp. The axial direction may be a longitudinal and may extend in a length direction of the elongated member. The axial direction may extend between the two ends of the elongated member.

The housing may include a clasp shell. The housing or the clasp shell may enclose a spacing in which at least part of the first clasp part, such as the head part described below, is positioned in its attached position.

The slider may in the releasing state allow for the first clasp part to be detached from the second clasp part when a force exerted on the first clasp part overcomes at least the magnetic attraction between the magnet and the magnetically attractable part.

The housing may include all parts of the second clasp part except for the slider.

The housing may comprise an opening through which the first clasp part is inserted when the first clasp part is moved to its attached position. The opening may lead into a spacing of the housing for receiving the first clasp part.

The housing may include a spacing corresponding to or matching the or a magnet, the magnet being positioned in the spacing, potentially attached thereto, potentially by means of glue.

The magnet(s) may have a cylindrical shape.

The housing may be a first half of the second clasp part, and the slider may be a second half of the second clasp part.

The housing and the slider may, at least in the locking state of the slider, i.e. a closed or locked position of the second clasp part, together form a cylindrical shape of the second clasp part. The housing may form a first half of the cylinder, and the slider may form a second half of the cylinder. Other shapes, such as spherical, of the closed clasp are also possible.

In an embodiment of the jewelry clasps of the invention, the magnet is a first magnet, and the part magnetically attractable by the magnet is a second magnet.

The magnets may be positioned with magnetic north and south poles thereof distributed along the axial direction. North and south poles of the magnets may face towards each other in the attached position of the first clasp part.

The part magnetically attractable by the magnet may alternatively be a magnetizable material, such as a ferromagnetic material, such as iron, so that the magnetic attraction is achieved with only a single magnet. In the latter case, the part magnetically attractable by the magnet may also be considered to form "a magnet", at least when the first clasp part is in its attached position.

In an embodiment, the magnet in the attached position of the first clasp part is held in abutment with the part magnetically attractable by the magnet.

In an embodiment, a head part of the first clasp part can be inserted into the housing through a radial opening of the housing, the radial opening in the locking state being at least partly covered by the slider, whereby the slider in the locking state prevents extraction of the inserted head part through the radial opening.

The head part may have a frusto-conical shape. A spacing with an opening at a tip end of the head part may receive the or a magnet. The magnet may have a cylindrical shape corresponding to or matching a cylindrically shaped spacing. The magnet may be attached in the spacing by means of glue.

In a further development of this embodiment, the first clasp part further comprises a neck part, the neck part having reduced cross-sectional extent compared to the head part, and wherein the axial end of the housing comprises a cut-out connected to the radial opening so that, in the attached position of the first clasp part, the neck part is positioned in the cut-out, whereby the axial end surface surrounding the cut-out prevents the head part from moving in an axial direction.

The axial end surface of the housing may form part of the shell of the housing.

The radial opening may be U-shaped. In its locking state, the slider may cover an opening formed by the upper opening of the U-shape.

The neck part may be a circumferential groove.

The radial opening may also be connected to the spacing in which the head part is positioned in the attached position of the first clasp part.

A cross-sectional extent of the neck part may be equal to or smaller than a cross-sectional extent of the cut-out. A cross-sectional extent of the head part may be larger than a cross-sectional extent of the cut-out. Hereby, the axial end of the housing may prevent the head part from being extracted from the housing if an axial force is exerted to pull the first clasp part or the head part axially away from the second clasp part.

Back surfaces of the head part may form barbs of the first clasp member, these barbs abutting an inner surface of the axial end around the cut-out when the second clasp part is in the attached position and an axial force is provided in an axial direction. This force may pull the first and second clasp parts away from each other. A back surface of the head part may form a barb of the first clasp member, this barb abutting an inner surface of the axial end when the second clasp part is in the attached position and an axial force is provided in an axial direction. This force may pull the first and second clasp parts away from each other. Similarly, the neck part may at an end thereof opposed to the head part be connected to another part of the first clasp part, this other part having a larger cross section than the neck part. This other part may form a connection to one end of the elongated member. And this other part may include a front surface that may form another barb of the first clasp member, this other barb abutting an outer surface of the axial end of the housing when the second clasp part is in the attached position and an axial force pushes the first and second clasp parts towards each other.

In an embodiment, the slider slides between the releasing and locking states by means of at least one tongue sliding in at least one groove.

The tongue may be a projection which may elongated and extend in the axial direction. The groove may be a track which may similarly be elongated and extend in the axial direction. The tongue may be inserted into the groove.

The or each tongue may be comprised in the slider or in the housing, the groove being comprised in the other of the slider and the housing.

The clasp may comprise two grooves, potentially of the housing, and two tongues, potentially of the slider, each tongue sliding in one of the grooves.

Two sets of each a tongue and a groove may be positioned at a distance from each other and extending radially inwards, which may prevent the slider from being detached from the housing in a radial direction but may allow the slider to slide.

For example, in case the slider is a half cylinder as described above, inward tongues may extend at or near edges of the slider facing the housing. These inwardly extending or projecting tongues may extend radially inwards into similarly radially inwardly extending grooves of the housing.

The slider may slide between the releasing and locking states by means of two elongated tongues or projections sliding in associated two elongated grooves or tracks. The tongues may be comprised in and may be in one piece with the slider, and the grooves may be comprised in and may be in one piece with the housing. Each tongue may slide in one of the grooves. The two tongues and two grooves may be positioned at a distance from each other at each of two end edges of the slider, may extend radially inwards and may prevent the slider from being detached from the housing in a radial direction but may allow the slider to slide. The inwardly projecting tongues may extend at end edges of the slider.

The tongues may be formed by associated two cut-outs in an interior surface of the slider. The cut-outs may be separated by a longitudinally extending wall of the slider, the depressions of the slider for the snap system may be provided in this wall, and the tongues may form similar walls at an opposite side of the associated cutout. Two radial protrusions may project outwardly, potentially in a radial direction, from and in one piece with the housing. These protrusions may each be partly formed by one of the grooves, may each be positioned within one of the two cut-outs, and may each be somewhat shorter in the sliding direction than the cut-outs. Each cut-out may further extend between two opposed axial end walls that may each abut associated end surfaces of the associated protrusion to limit sliding movement of the slider beyond its releasing and locking states and prevent it from being removed in the sliding direction. Cooperation between the grooves and tongues may further prevent the slider from being removed in a radial direction.

In an embodiment, the jewelry clasp further comprises a snap lock which engages the slider and the housing when the slider is in the locking and/or in the releasing state so that a force in a sliding direction disengages the snap lock to allow the slider to slide to the other of the locking and/or releasing states, respectively.

In a further development of this embodiment, the snap lock includes a first snap lock part of the housing and a second snap lock part of the slider, and wherein the first snap lock part includes a spring-biased part which in the releasing and/or locking states is inserted into the second snap lock part taking the form of a depression of the slider.

Alternatively, the first snap lock part is of the slider, and the second snap lock part is of the housing.

The spring-biased part may be a ball. The depression(s) may have a shape corresponding to the shape of the spring-biased part. This may allow the spring-biased part or ball to be pressed out of the depression when a slide force is exerted on the slider in its locking or releasing states. The spring may be positioned in a cut-out of the housing, the spring-biased part being positioned in or at an opening of the cut-out.

In an alternative embodiment, the spring-biased part comprises an attaching element. The attaching element may be provided separately from the spring-biased part. Alternatively, the attaching element and the spring-biased part may be formed integrally and provided as one part. The attaching element may comprise a base and/or at least one arm. The attaching element, and preferably the arm is configured to engage with the slider in the releasing and/or locking states. The attaching element may be formed as a barb, having a base at its lower part and two arms projecting from the base towards the slider, when the snap lock is inserted into the second clasp part. Preferably, the attaching element may have a U-shape. The attaching element may abut the spring-biased part in an upper surface of its base.

The slider may comprise a cut-out which may extend between two opposed axial end walls. The end walls may be plane and vertical, wherein each wall may be configured to abut the arm of the attaching element to limit sliding movement of the slider beyond its releasing and locking states and prevent the spring-biased part from falling off.

The spring-biased part may comprise a circular surface, wherein the snap lock may snap by means of the circular surface. The circular surface may be positioned on the upper part of the spring-biased part. Alternatively, the spring-biased part may comprise an inclined, round and/or cylindrical surface. The attaching element, preferably the arm, may comprise a radially plane, vertical surface which may act as a stop, when abutting the plane, vertical end wall of the slider in a sliding movement of the slider. The provision of the vertical end wall and its abutment with the arm may act as a stop and prevent the spring-biased part from moving further in the axial direction, thus falling off when the slider is slid from the releasing to its locking state and/or vice versa. This may allow for a safer and more secure snap-lock.

The slider may comprise two depressions, the ball in the releasing state of the slider snapping into one of the depressions and in the locking state of the slider snapping into the other of the two depressions.

In an embodiment, a magnet is positioned and held in a head part of the first clasp part.

In an embodiment, a magnet is positioned and held in a spacing in the housing.

In an embodiment, the magnet is positioned so that, in the attached position of the first clasp part, the magnetic attraction works in an axial direction of the clasp.

In an embodiment, the magnetic attraction assists in drawing the first clasp part into its attached position.

Another aspect of the invention involves a piece of jewelry comprising an elongated member and a jewelry clasp according to any one of the above embodiments, wherein the first clasp part is attached to or is one end of the elongated member, and the second clasp part is attached to or is the second end of the elongated member so that the clasp secures the first end to the second end when the first clasp part is in the attached position.

As mentioned above, the piece of jewelry may be a bracelet, necklace, anklet, or the like.

Said one end of the elongated member may be attached to the first clasp part. Said one end of the elongated member may be inserted into the first clasp part, potentially in a spacing thereof, which may be positioned oppositely from the head part of the first clasp part. Alternatively, the attachment may be provided by a hook-and-loop connection or the like. Similarly, the second end of the elongated member may be attached to the second clasp part. The second end of the elongated member may be inserted into the second clasp part, potentially in a spacing thereof, which may be positioned oppositely from the spacing of the housing receiving the first clasp part.

A further aspect of the invention involves a method of closing the jewelry clasp of any one of the above embodiments. The method includes inserting at least part of the first clasp part within the housing so that the first clasp part is brought into its attached position; and sliding the slider from its releasing state to its locking state preventing the first clasp part from being detached from the second clasp part.

A further aspect of the invention involves a method of opening the jewelry clasp of any one of the above embodiments. The method includes sliding the slider from its locking state to its releasing state to allow the first clasp part positioned in its attached position to be detached from the second clasp part; and exerting a force on the first clasp part to overcome the magnetic attraction and extract at least part of the first clasp part from the housing.

The force may be in a non-axial direction and preferably in a radial direction being perpendicular to the axial or sliding direction.

The wearer or user of the jewelry clasp may not need to press or insert his/her fingernails into a cut-out to open or release the clasp. This may allow for an easier opening without damaging the fingernails. Furthermore, the magnetic force bringing the first clasp part into its attached position may have the advantage of an easier and faster closing of the jewelry clasp.

The methods according to the invention may also be carried out on the jewelry clasps of the pieces of jewelry comprising the jewelry clasp.

Further embodiments and advantages of the jewelry clasps, pieces of jewelry, and methods according to the invention are disclosed in the subsequent detailed description and in the drawings.

BRIEF DESCRIPTION OF THE DRAWINGS

In the following, an embodiment of a jewelry clasp according to the invention will be described with reference to the enclosed drawings, in which.

WRITTEN DESCRIPTION

Figure 1:
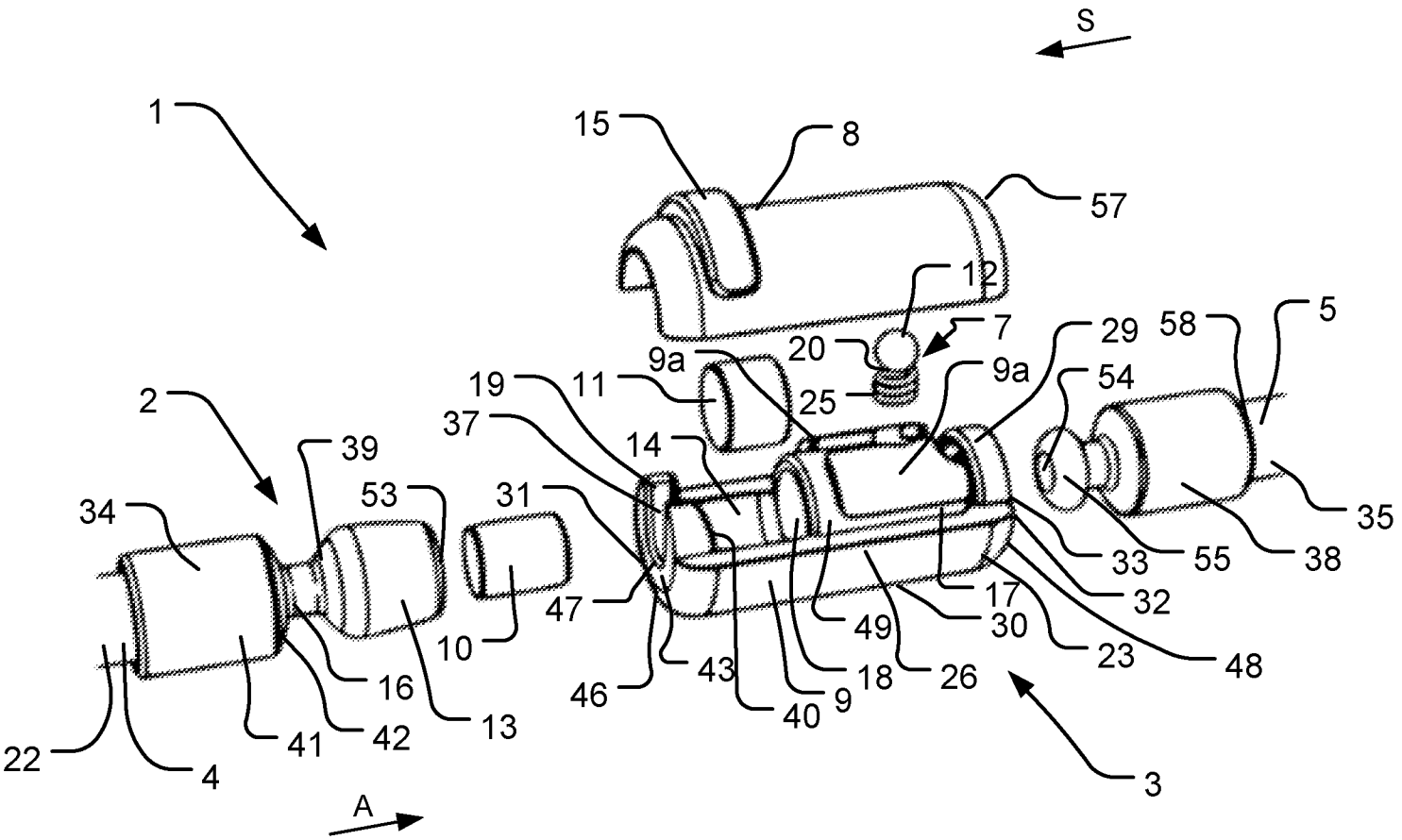
FIG. 1 is an exploded perspective view of an embodiment of the jewelry clasp according to the invention.

FIGS. 1 to 9 show different views of a jewelry clasp 1 or parts thereof. In FIGS. 1 to 7, two ends 4, 5 of an elongated member 22 of a piece of jewelry in the form of a bracelet (otherwise not shown), of which the clasp 1 forms part, are also shown. The jewelry clasp 1 comprises a first clasp part 2, a second clasp part 3, and a slider 8. In FIGS. 2, 3, 5, and 6, the slider 8 is in a releasing state, while in FIGS. 4 and 7 the slider 8 is in a locking state.

Figure 2:
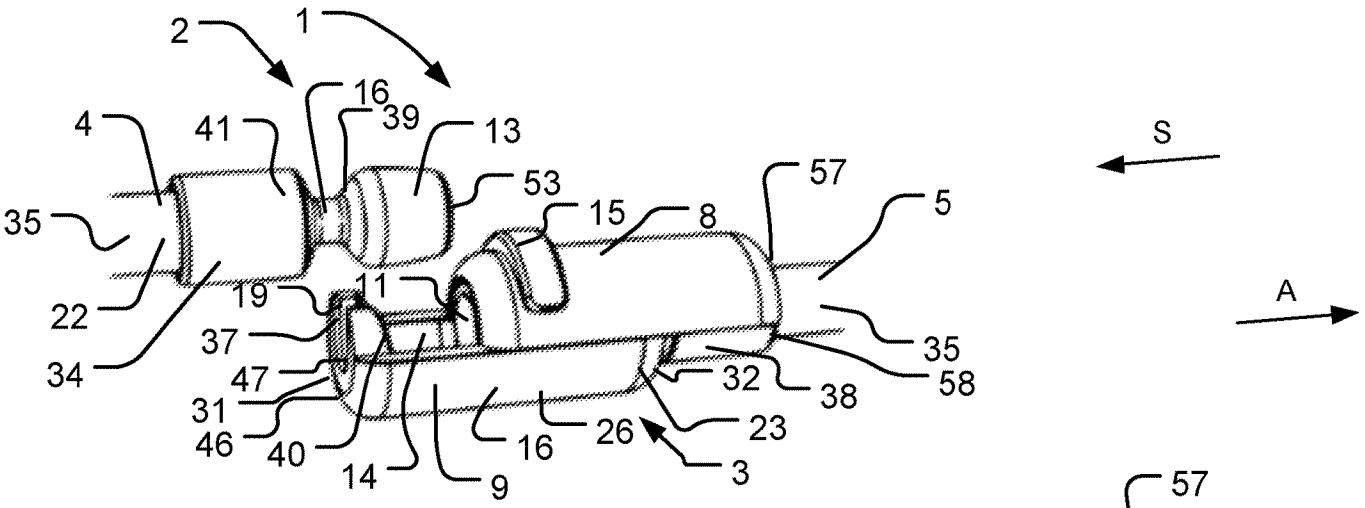
FIG. 2 is a perspective view of the embodiment of FIG. 1 in an assembled condition, a first clasp part of the jewelry clasp being in a detached position, and a slider of a second clasp part being in a releasing state.

The jewelry clasp 1 is intended for securing a first end 4 of an elongated member 22 of the bracelet to a second end 5 of the elongated member 22. In an attached position of the first clasp part 2, as shown in FIGS. 3 to 4 and 6 to 7, the first clasp part 2 is received in a housing 9 of the second clasp part 4. In a detached position, the first clasp part 2 is not inserted into the housing 9 of the second clasp part 3, as shown in FIGS. 2 and 5.

Figure 6:
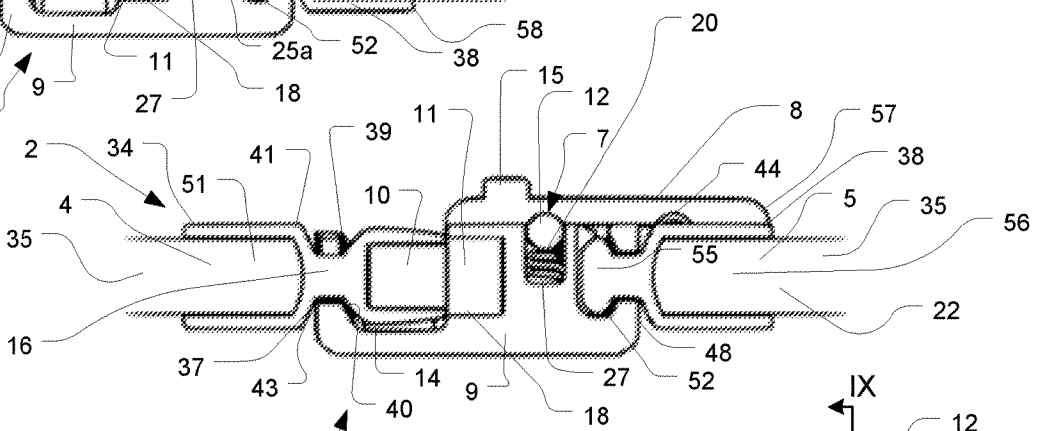
FIG. 6 corresponds to the view of FIG. 3, but in a cross-sectional side view.
Figure 7:
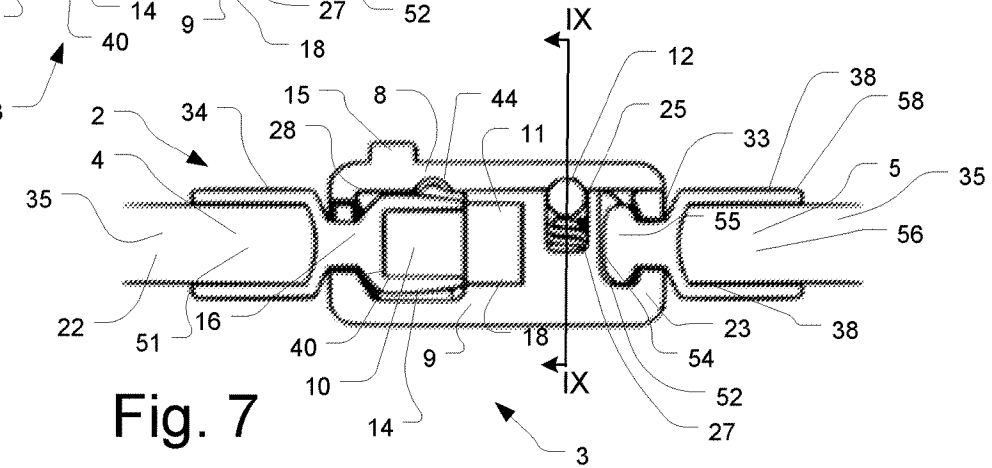
FIG. 7 corresponds to the view of FIG. 4, but in a cross-sectional side view.

The first clasp part 2 comprises a first magnet 10, and the second clasp part 3 comprises a second magnet 11, so that the first clasp part 3 in its attached position is held to the second clasp part 4 by magnetic attraction, as shown in FIGS. 6 and 7.

Figure 3:
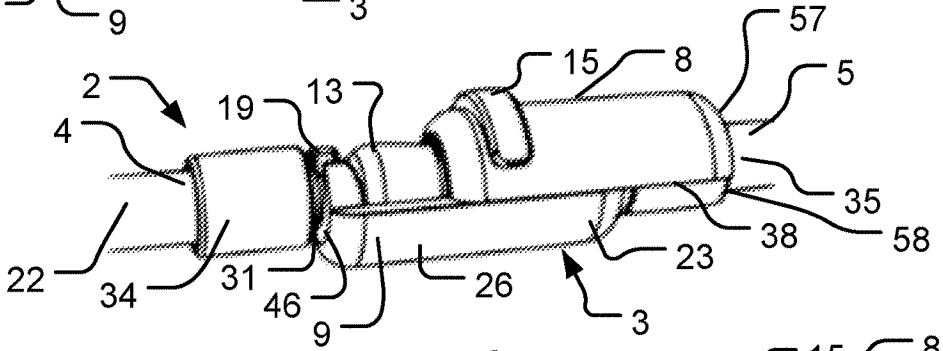
FIG. 3 is a view corresponding to that of FIG. 2, wherein the first clasp part has been moved to an attached position.

The jewelry clasp 1 also comprises the slider 8, which is attached to and slideable in relation to the housing 9 of the second clasp part 4. The slider 8 is slideable between a releasing state and a locking state. The releasing state allows for the first clasp part 2 to be detached from the second clasp part 3, as seen in FIGS. 3 and 6. In the locking state, the slider 8 prevents the first clasp part 2 from being detached from the second clasp part 3.

The first magnet 10 and the second magnet 11 provide an initial attachment of the first 2 and second 3 clasp parts. This magnetic lock may be easily activated by one hand by bringing the first 2 and second 3 clasp parts close together. The slider 8 is slid to the locking state to provide a safety lock to ensure that the clasp parts 2, 3 are not accidentally released from each other. When releasing the clasp parts 2, 3 from each other, the slider 8 is slid to return to its releasing state after which the magnets 10, 11 will continue to keep the two clasp parts 2, 3 together. Slideable beads or charms may be strung on the bracelet over the first clasp part 2 in its released position, the clasp 1 in its closed condition preventing the beads or charms from falling off.

As shown in FIGS. 2 to 7, the sliding movement of the slider 8 occurs in an axial or length direction A of the jewelry clasp 1 and of the elongated member 22 to be attached to the jewelry clasp 1. The axial direction A is a longitudinal direction and extends in a length direction of the elongated member 22 between the two ends 4, 5 of the elongated member 22. The axial direction A extends in the same dimension as a sliding direction S of the sliding movement of the slider 8, as seen best in FIGS. 3 and 4. The sliding direction S is thus parallel to the axial direction A.

The second clasp part 3 comprises two parts, as seen best in FIG. 1, where the housing 9 is a first half part and the slider 8 is a second half part of the second clasp part 3. The second clasp part 3 has a length of 12 mm and a width of 6 mm when the slider 8 is in its locking state. The housing 9 includes a clasp shell 23. The housing 9 or the clasp shell 23 enclose a spacing 14, in which a head part 13 of the first clasp part 2 is received in its attached position. A circumferentially extending outer wall 26 of the housing 9 defines the spacing 14. The housing 9 is made of metal. The housing 9 further comprises cylindrical wall sections, as shown in FIG. 1.

As seen in FIG. 7, the housing 9 encloses together with the slider 8 in its locking state a generally cylindrical closed spacing 28, the spacing 28 comprising the spacing 14 of the housing 9. A first opening 19 in an axial end wall of the housing is connected to the closed spacing 28 and receives a neck part 16 of the first clasp part 2. The spacing 28 extends from the axial end of the housing 9 towards an opposed axial end of the housing.

When the slider 8 is in its releasing state, it allows for the first clasp part 2 to be detached from the second clasp part 3 when a force exerted, typically by a hand or finger, on the first clasp part 2 overcomes the magnetic attraction between the first magnet 10 and the second magnet 11.

The housing 9 includes all parts of the second clasp part 3 except for the slider 8. The housing 9 comprises the opening 19 into which the neck part 16 of the first clasp part 2 is inserted when the first clasp part 2 is moved to its attached position. The housing 9 includes a spacing 18 in which the second magnet 11 is received. The spacing 18 is defined by an interior surface of the housing 9. The second magnet 11 is enclosed in the housing 9, positioned in the spacing 18, and here attached by means of glue. The spacing 18 is in the form of a cut-out extending from the spacing 14 in the housing towards an opposed axial end 48 of the housing and a second opening 33, where the second end 5 of the elongated member 22 is received.

The magnets 10, 11 have a cylindrical shape. The magnet 10 has a width that is smaller to a length of the magnet 10. The second magnet 11 has a width that is substantially larger than a length of the second magnet 11. The width is defined as extending in a radial direction, while the length is defined as extending in an axial direction. A diameter of the spacing 18 is of corresponding size to a diameter of the second magnet 11.

Figure 4:
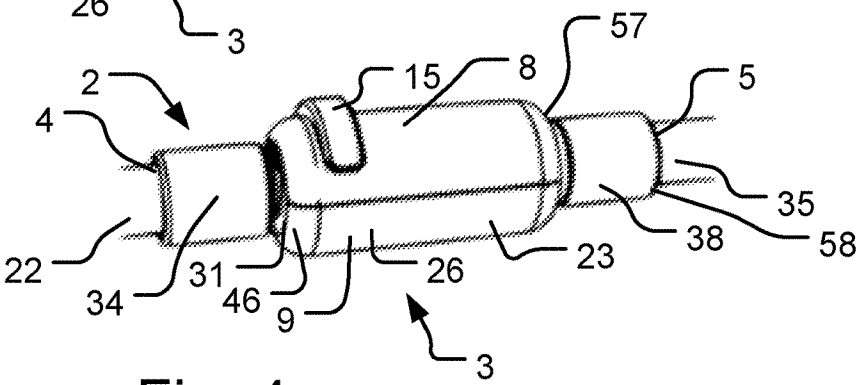
FIG. 4 is a view corresponding to that of FIG. 3, wherein the slider has been moved to a locking state.
Figure 5:
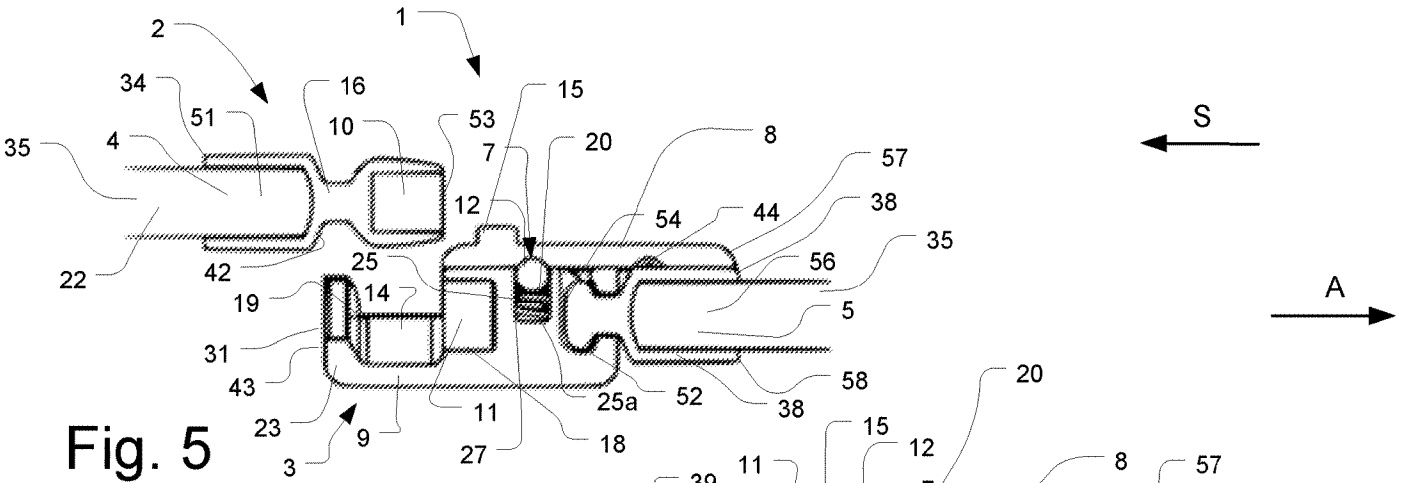
FIG. 5 corresponds to the view of FIG. 2, but in a cross-sectional side view.

As seen in FIG. 4, the housing 9 and the slider 8, in the locking state of the slider 8, together form a generally cylindrical shape of the second clasp part 3. As described above, the housing 9 forms a first half, and the slider 8 forms a second half, of this cylinder.

The slider 8 comprises a radially and outwardly protruding grip projection 15, which allows the jewelry wearer to grip the slider 8 by a finger when sliding the slider 8 between the locking and releasing states. The grip projection 15 extends along a part of a perimeter of the slider 8. A cross-section of the slider 8 is substantially a semicircle. The perimeter of the slider 8 is the perimeter corresponding to the semicircle. The grip projection 15 extends circumferentially along more than 70% of the perimeter of the slider 8. The grip projection 15 has a length that is of larger size than, substantially two times, the width of the grip projection 15.

The clasp shell 23 of the invention comprises a top 29, a bottom 30 positioned oppositely from the top 29, a first side 31, and a second side 32, the first and second sides 31, 32 connecting the top 29 and bottom 30. The first side 31 and the second side 32 are positioned oppositely from each other, as seen in e.g. FIG. 1.

The housing 9 comprises the first opening 19 and a second opening 33. The first opening 19 is positioned at the first axial end wall 46 of the housing and in the first side of the clasp shell 31. The first clasp part 2 is received in the first opening 19 in its attached position. The second opening 33 is positioned in an opposed axial end wall 48 of the housing, in the second side of the clasp shell 32, and is for receiving the second end 5 of the elongated member 22 of a piece of jewelry.

As described above, the jewelry clasp 1 comprises two magnets 10, 11 exerting a magnetic force. The second magnet 11 is positioned in the spacing or cutout 18 positioned oppositely from the first opening 19 of the housing 9. The second magnet 11 at one end or pole abuts the clasp shell 23 and at the other end or pole abuts the first clasp part 2 in its attached position.

The first magnet 10 is located in the head part 13 of the first clasp part 2. The first magnet 10 extends along substantially the entire length of the head part 13 from a first end or tip part 53 of the head part 13 towards the neck part 16. The first end 53 is the free end of the head part 13, which is brought into abutment with the second magnet 11 in the attached position of the first clasp part 2.

The first clasp part 2 can be assisted in its movement to its attached position shown in FIG. 6 by the attraction between the first magnet 10 and the second magnet 11, i.e. by the opposite polarity between the two magnets 10, 11. When the slider 8 is in its releasing state, the first clasp part 2 may be extracted from the jewelry clasp 1 by pulling it out of the housing 9, overcoming the magnetic attraction.

The first clasp part 2 comprises a cap 34 that is positioned to receive and attach the first end 4 of the elongated member 22, the latter further comprises an intermediate, flexible portion 35 leading to the second end 5 of the elongated member 22. The head part 13 has a truncated conical shape. The cap 34 is positioned adjacent to the neck part 16 of the first clasp member 2. The neck part 16 connects the cap 34 to the head part 13 of the first clasp part 2. The neck part 16 has a reduced cross-sectional extent compared to the head part 13.

The axial end 46 of the housing comprises an opening or cut-out 37 connected to the radial first opening 19 so that, in the attached position of the first clasp part 2, the neck part 16 is positioned in the cut-out 37. The axial end surface 47 surrounding the cut-out 37 prevents the head part 13 from moving in the axial direction A. The axial end surface 47 of the housing forms part of the shell 23 of the housing 9.

The cross-sectional extent of the neck part 16 is smaller than a cross-sectional extent of the cut-out 37. Hereby, the axial end 46 of the housing 9 prevents the head part 13 from being extracted from the housing 9 when an axial force is exerted to pull the first clasp part 2 or the head part 13 axially away from the second clasp part 3.

As seen in, e.g., FIG. 6, back surfaces 39 of the head part 13 form barbs of the first clasp member 2. The barbs abut an inner surface 40 of the axial end 46 around the cut-out 37 when the first clasp part 2 is in the attached position and an axial force is provided in the axial direction A, this force pulling the first 2 and second 3 clasp parts away from each other.

The neck part 16 is at an end opposed to the head part 13 connected to another part 41 of the cap 34 of the first clasp part 2, this other part 41 and the cap 34 having a larger cross section than the neck part 16. The other part 41 forms a connection to the first end 4 of the elongated member 22. The other part 41 includes a front surface 42 that forms another barb of the first clasp member 2. The other barb or front surface 42 abuts an outer surface 43 of the axial end 46 of the housing 9 when the first clasp part 3 is in the attached position and an axial force pushes the first 2 and second 3 clasp parts towards each other.

The second end 5 of the elongated member 22 includes a cap 38, which is attached to the flexible intermediate portion 35 of the elongated member 22. The second end 5 of the elongated member 22 is inserted in the second opening 33 of the housing (FIG. 1) and extends from the opening 33 into the spacing of the clasp shell (FIGS. 5 to 7). The cap 38 of the second end 5 of the elongated member comprises a tip 55 which is formed as a knob. The tip 55 is first inserted into a spacing 52 of the second clasp part 3. The spacing 52 is positioned adjacent to the second opening 33 of the housing 9 at the second side 32 of the clasp shell when the second end 5 of the elongated member 22 is received through the second opening 33 into the housing 9.

The magnets 10, 11 are positioned with magnetic north and south poles distributed along the axial direction A. In the attached position of the first clasp part 2, the north and south poles of the magnets 10, 11 face each other. The first magnet 10 is in the attached position of the first clasp part 2 held in abutment with the second magnet 11.

FIG. 3 shows the first clasp part 2 in the attached position, where the head part 13 of the first clasp part has been inserted into the housing 9 through the radial first opening 19 of the housing 9. The radial first opening 19 is in the locking state shown in FIG. 4 covered by the slider 8. In its locking state, the slider 8 prevents extraction of the inserted head part 13 through the radial opening 19. The radial opening 19 is U-shaped. In its locking state, the slider 8 covers the opening or cut-out 37 formed by the upper opening of the U-shape. The radial opening 19 is connected to the spacing 14 in which the head part 13 is positioned in the attached position of the first clasp part 2.

In the releasing state shown in FIG. 6, the slider 8 covers substantially entirely an upper part of a cap 38 covering the second end 5 of the elongated member 22. In the releasing state, a second end 57 of the slider 8 is aligned with a second side 58 of the cap 38 of the second end 5 of the elongated member, such that the cap 38 does not protrude out of the slider in the axial direction. In its locking state, the second end 57 of the slider 8 is positioned on top of the second opening 33 of the housing 9.

Figure 9:
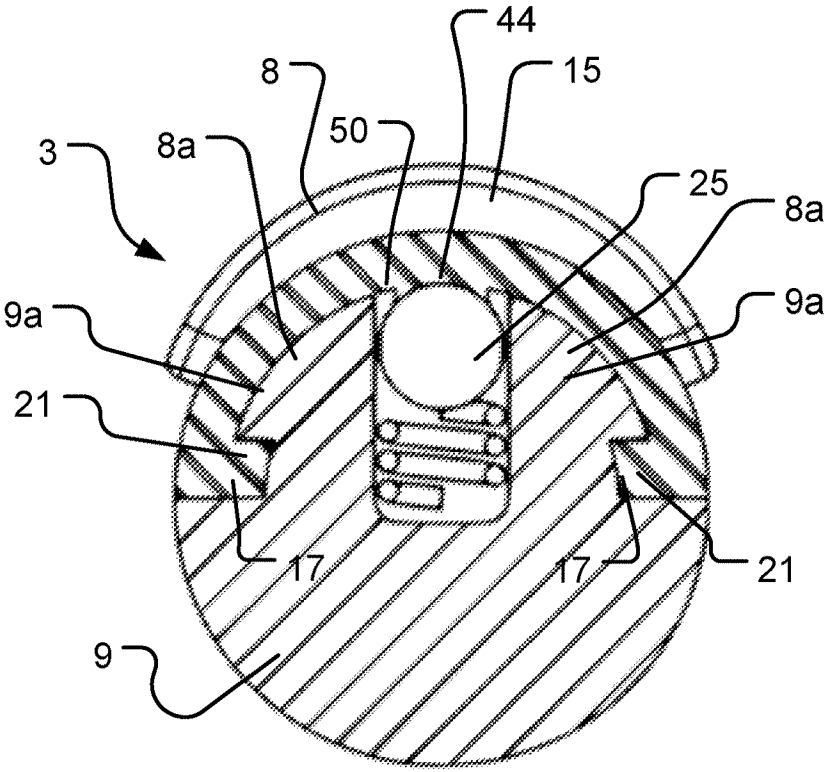
FIG. 9 shows a cross-sectional view taken along the line IX-IX of FIG. 7.
Figure 8:
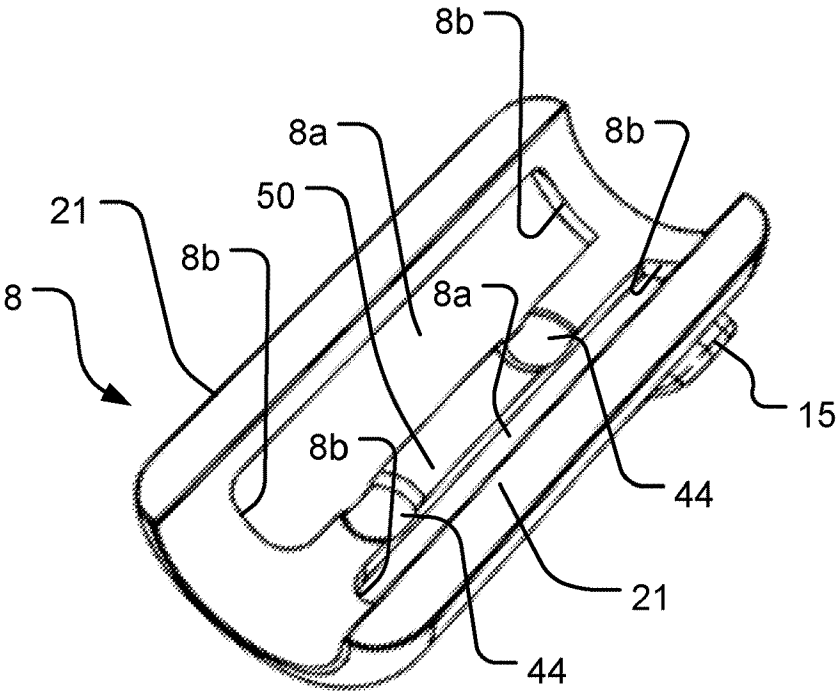
FIG. 8 shows a perspective bottom view of the slider.

Referring also to FIGS. 8 and 9, the slider 8 slides between the releasing and locking states by means of two elongated tongues or projections 21 sliding in associated two elongated grooves or tracks 17. The projections 21 are comprised in and in one piece with the slider 8, and the grooves 17 are comprised in the housing 9 and are in one piece with the clasp shell 23. Each tongue 21 slides in one of the grooves 17. The two tongues and two grooves 17 are positioned at a distance from each other at each of two end edges of the slider 8 and extend radially inwards, preventing the slider 8 from being detached from the housing 9 in a radial direction but allowing the slider 8 to slide in the axial direction A. The inwardly projecting tongues 17 extend at end edges of the slider 8.

The tongues 21 are formed by respective two cut-outs 8*a* in an interior surface of the slider 8, see FIG. 8. The cut-outs 8*a* are separated by a longitudinally extending wall 50 of the slider 8, the depressions 44 being provided in this wall 50, and the tongues 21 form similar walls at an opposite side of the associated cut-out 8*a*. Two radial protrusions 9*a* project outwardly in a radial direction from and in one piece with the housing 9, see FIG. 1. These protrusions 9*a* are each partly, i.e. at one side, formed by one of the grooves 17, are each positioned within one of the two cut-outs 8*a* and are each somewhat shorter in the axial direction A than the cut-outs 8*a*. Each cut-out 8*a* further extends between two opposed axial end walls 8*b* that each abuts associated end surfaces of the associated protrusion 9*a* to limit sliding movement of the slider 8 beyond its releasing and locking states and prevent it from being removed in the axial direction A. Cooperation between the grooves 17 and associated tongues 21 further prevent the slider 8 from being removed in a radial direction, the protrusions forming barbs against removal due to the shapes of the tongues 21 and grooves 17.

As seen in FIGS. 1 and 5 to 7, the jewelry clasp 1 further comprises a snap lock 7 which locks the slider 8 in relation to the housing 9 when the slider 8 is in the locking and releasing states, respectively. A force in the sliding direction S disengages the snap lock 7 to allow the slider 8 to slide to the other of the locking and/or releasing states, respectively. The snap lock 7 includes a first snap lock part 20 of the housing 9 and a second snap lock part of the slider 8. The second snap lock part included consists of two depressions 44. The first snap lock part 20 includes a spring-biased part 25, which is inserted into a depression 27 of the housing 9.

The spring-biased part 25 comprises a ball 12 in an upper part of the spring-biased part 25. The depression 27 has a shape corresponding to the shape of the spring-biased part 25. In a well-known manner, this allows the ball 12 to be pressed in a direction out of the depression 27 when a slide force is exerted on the slider 8 in its locking or releasing states. The spring-biased part 25 comprises a helical compression spring 25*a*, which is positioned in the depression 27 of the housing 9. The ball 12 is of metal and has a diameter that is of substantially equal size to the length or diameter of the depression 27. In the locking and releasing states of the slider 8, part of the ball 12 projects outwardly from the depression 27. Between the locking and releasing states, the ball 12 is forced into the depression 27 by the slider 8.

As seen in FIGS. 5 to 7, the slider 8 comprises two depressions 44. In the releasing state of the slider 8, the ball 12 snaps into one of the two depressions 44 and, in the locking state of the slider 8, into the other of the two depressions 44.

The first end 4 of the elongated member 22 is inserted into and secured in a spacing 51 of the cap 34 of the first clasp part 2, the cap 34 being positioned oppositely from the head part 13 of the first clasp part 2. The second end 5 of the elongated member 22 is inserted into and secured in a spacing 52 of the cap 38 of the second clasp part 3, the cap 38 being positioned oppositely from the tip 55.

The jewelry clasp 1 may be closed according to the following sequence of method steps, as illustrated by FIGS.

2 to 4 and 5 to 7, respectively. First (FIGS. 2 and 3; and 5 and 6, respectively), the first clasp part 2 is inserted into the housing 9 through the first opening 19, so that the first clasp part 2 is brought into its attached position. Then (FIGS. 3 and 4; and 6 and 7, respectively), the slider 8 is slid from its releasing state to its locking state so that the first clasp part 2 is prevented from being detached from the second clasp part 3.

The jewelry clasp 1 may be opened according to a reverse sequence of method steps. First, the slider 8 is slid from its locking state to its releasing state to allow the first clasp part 2 positioned in its attached position to be detached from the second clasp part 3. Then a force is exerted on the first clasp part 2, e.g., by a hand or finger, to overcome the magnetic attraction and extract the first clasp part 2 from the housing 9.

Figure 10:
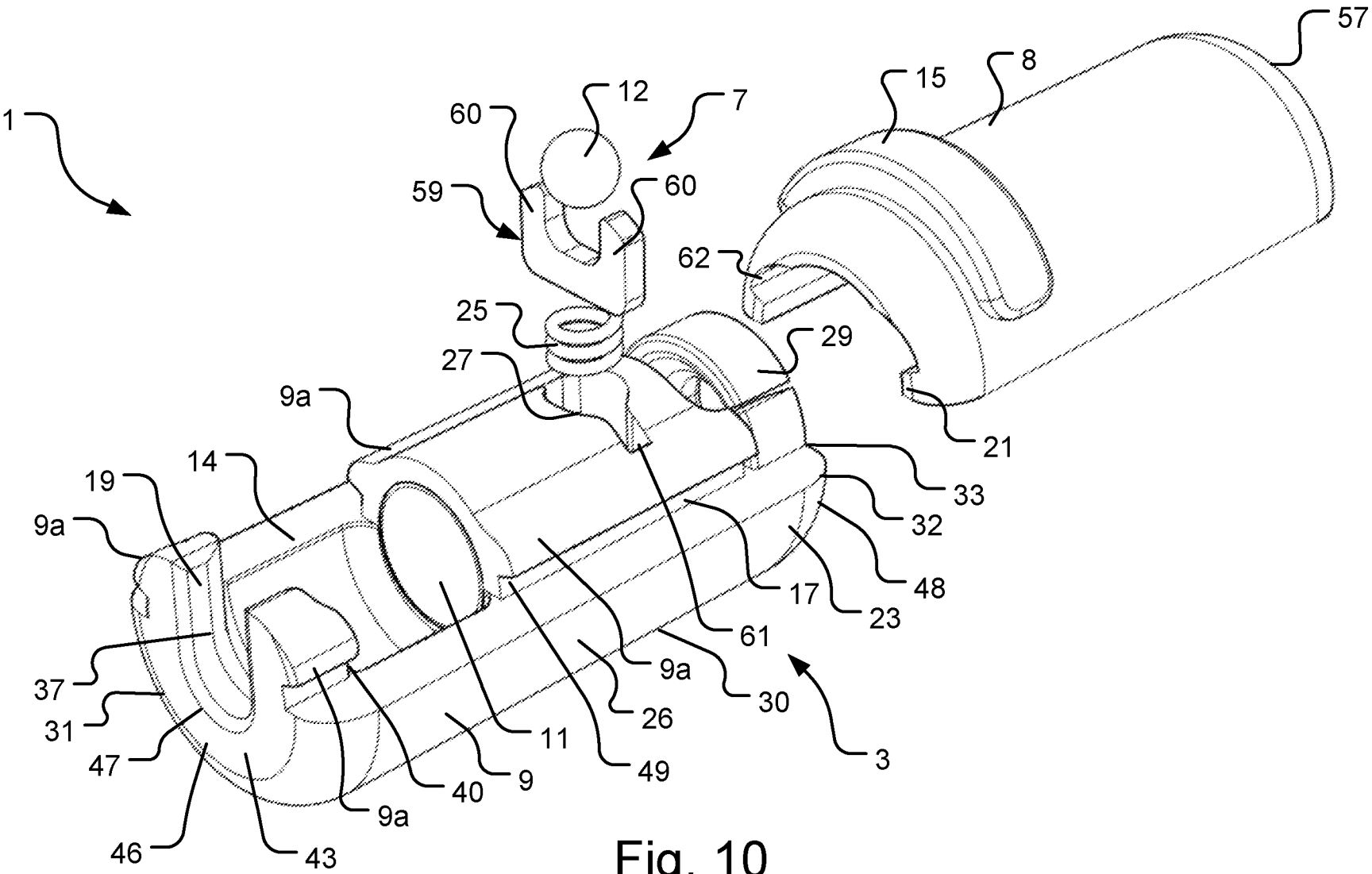
FIG. 10 is an exploded perspective view of an alternative embodiment of the jewelry clasp according to the invention.
Figure 11:
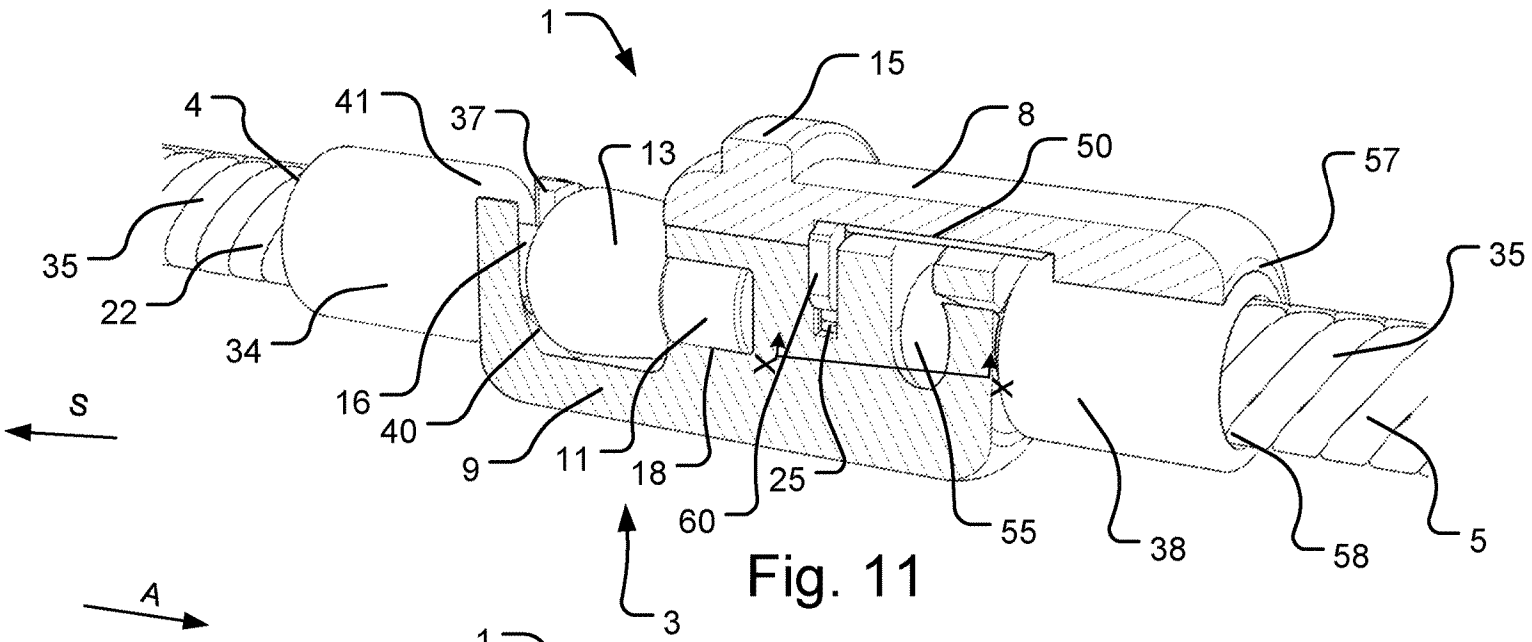
FIG. 11 is a cross-sectional view corresponding to that of FIG. 10, wherein the first clasp part has been moved to an attached position and wherein a part of the slider and a part of the second clasp part have been removed.
Figure 12:
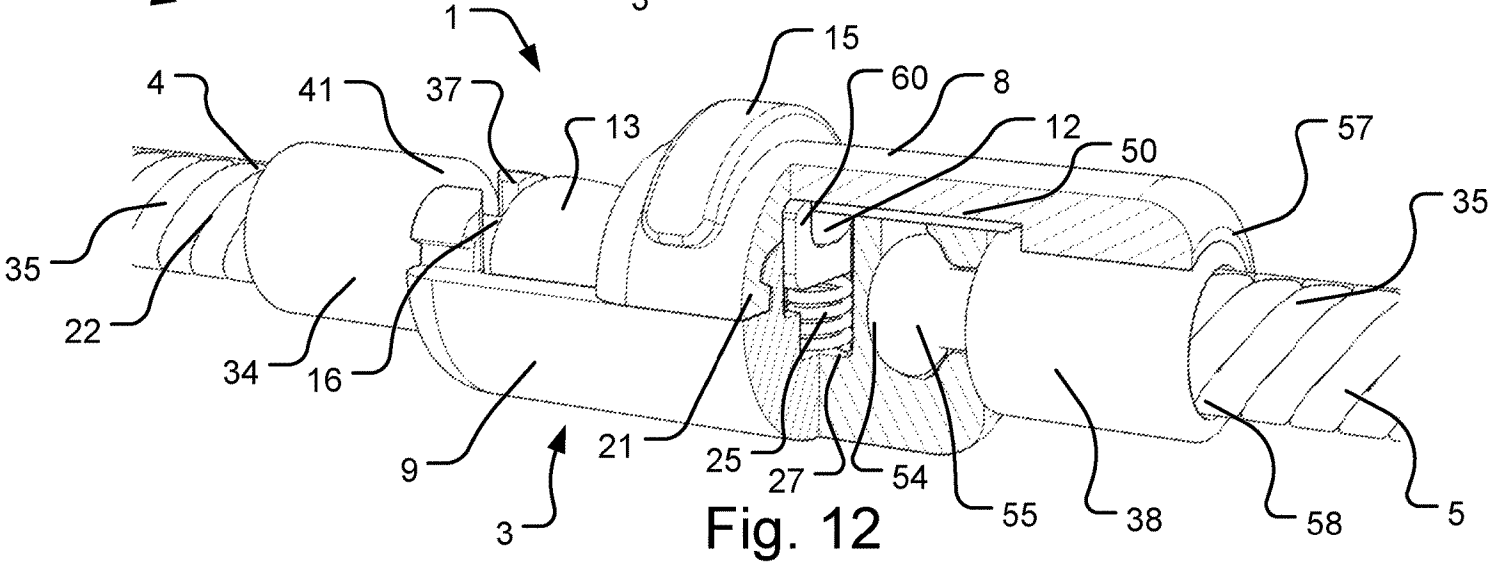
FIG. 12 is a cross-sectional view corresponding to that of FIG. 11, wherein the first clasp part has been moved to an attached position and wherein a part of the slider and a part of the second clasp part have been removed along the section X-X of FIG. 11.
Figure 13:
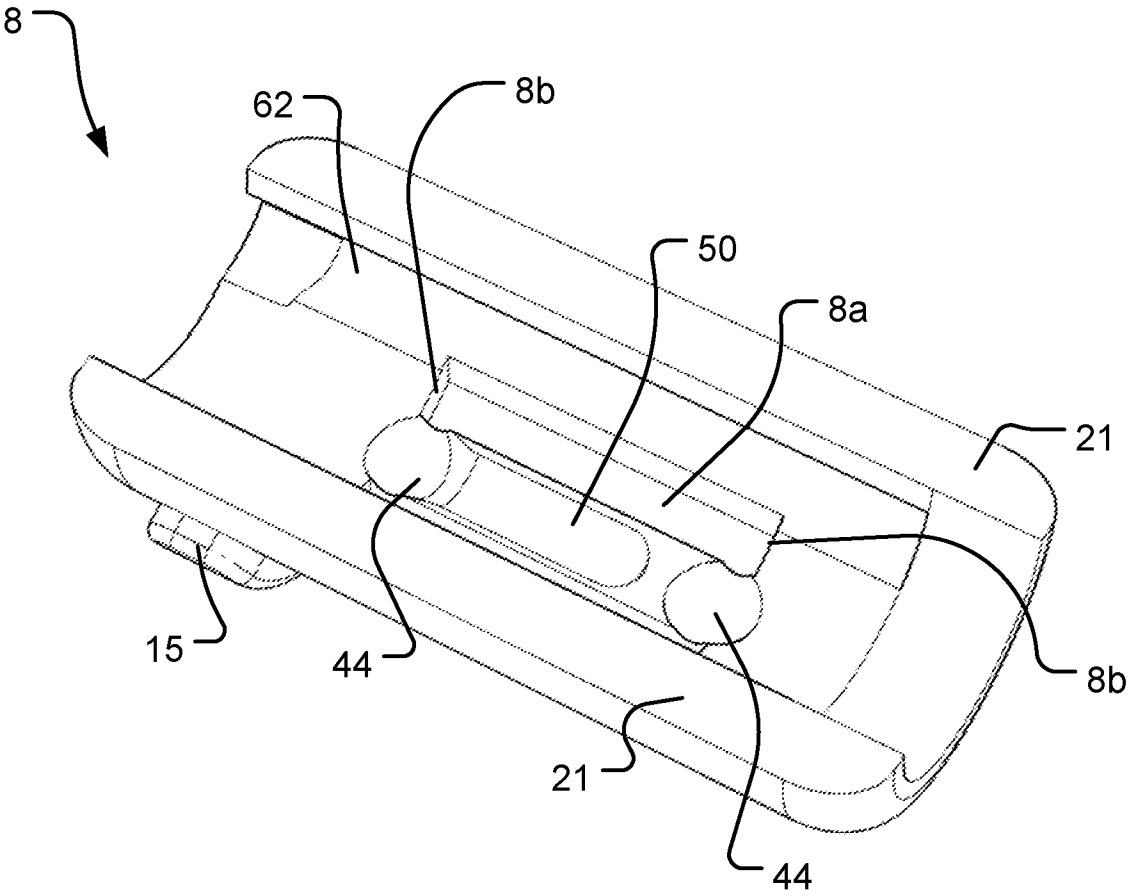
FIG. 13 shows a perspective bottom view of the slider corresponding to that of FIG. 10.

FIGS. 10 to 13 show an alternative embodiment according to the invention, wherein FIG. 10 shows an exploded perspective view of the jewelry clasp comprising an attaching element 59, while FIGS. 11 and 12 show cross-sectional views of the jewelry clasp of FIG. 10, wherein different parts of the slider 8 and the second clasp part 3 have been removed for illustrative purposes. In FIGS. 11 and 12, the slider 8 is in its releasing state. FIG. 13 shows a perspective bottom view of the slider 8.

In the embodiment shown in FIGS. 10-12, the spring-biased part 25 comprises the attaching element 59. The attaching element 59 supports the ball 12 and is configured to engage with the slider 8 in the releasing and/or locking states. The attaching element 59 is formed as a barb having a U-shape. The attaching element 59 comprises a base and two arms 60 which project from the base towards the slider 8. The ball 12 abuts the attaching element 59 at an upper surface of its base, shown in FIG. 10. Each arm 60 is configured to move inside the cut-out 8*a* of the slider 8, shown in FIG. 13. The cut-out 8*a* of the slider 8 extends between two opposed axial end walls 8*b*, the walls 8*b* being plane and vertical. Each wall 8*b* is configured to abut the arm 60 of the attaching element 59 to limit sliding movement of the slider 8 beyond its releasing and locking states and prevent the spring-biased part 25 or ball 12 from falling off, when the spring biased part 25 moves past the depression 44. The attaching element 59 and specifically the arm 60 comprises a radially plane, vertical surface which acts as a stop, when abutting the end wall 8*b* in a sliding movement of the slider 8.

The spring-biased part 25 comprises a circular surface on the upper part of the ball 12, wherein the snap lock snaps by means of the circular surface. The circular surface of the ball 12 is configured to engage with the circular surface of the depression 44 of the second snap lock part.

As mentioned above, the spring-biased part 25 is inserted into the depression 27 of the housing 9. The depression 27 also has a recess 61 shaped such as to accommodate the attaching element 59. Two cut-outs 8*a* are comprised in the interior surface of the slider 8, better shown in FIG. 13. The cut-outs 8*a* are separated by the longitudinally extending wall 50 of the slider 8, the depressions 44 being provided in this wall 50. Adjacent to the cut-outs 8*a*, two respective troughs 62 are formed on the interior surface of the slider 8 which engage with the two radial protrusions 9*a* of the housing 9, see FIG. 10. The troughs 62 are formed in the interior surface of the slider 8 comprising portions with reduced material. In this embodiment, the protrusions 9*a* are each positioned within one of the two troughs 62. The protrusions 9*a* extend in the axial direction to the axial end 46 of the housing and are discontinued by the spacing 14 in the housing. The protrusions 9*a* have substantially the same length in the axial direction with the troughs 62. The formation of the axial end walls 8*b* as vertical and plane and their cooperation with the arms 60 of the attaching element 59 which also comprise a radially plane, vertical surface, further prevents the ball 12 from moving further in the axial direction A and past the depressions 44, eventually falling off, when the slider 8 is slid from the releasing to its locking state and vice versa.

The disclosure is not limited to the embodiments shown and described in the above, and various modifications and combinations may be carried out.

LIST OF REFERENCE SIGNS

1 Jewelry clasp
2 First clasp part
3 Second clasp part
4 First end of elongated member 22
5 Second end of elongated member 22
7 Snap lock
8 Slider
8*a* Cut-outs
8*b* Side walls
9 Housing of second clasp part
9*a* Radial protrusions
10 First magnet
11 Second magnet
12 Ball
13 Head part of first clasp part
14 Spacing in housing
15 Grip projection
16 Neck part of first clasp part
17 Groove
18 Spacing for receiving magnet 11
19 First opening of housing
20 First snap lock part
21 Tongue
22 Elongated member
23 Clasp shell
25 Spring-biased part
25*a* Spring
26 Outer wall of housing
27 Depression
28 Enclosed spacing for receiving first clasp part 2
29 Top of clasp shell 23
30 Bottom of clasp shell
31 First side of clasp shell
32 Second side of clasp shell
33 Second opening of housing 9
34 Cap of first clasp part Intermediate portion of
35 elongated member 22
37 Cut-out
38 Cap of second clasp part
39 Back surface of head part
40 Inner surface of axial end 46
41 Other part of cap 34
42 Front surface of other part 41
43 Outer surface of axial end 46
44 Depressions
46 Axial end of housing
47 Axial end surface
48 Opposed axial end of housing
49 End of track 17
50 Longitudinally extending wall
51 Spacing of first end
52 Spacing of second clasp part

53 First end of head part 13
55 Tip of cap 38
56 Spacing in cap 38
57 Second end of slider 8
58 Second side of cap 38
59 Attaching element
60 Arms of attaching element 59
61 Recess of depression 27
62 Trough
S Sliding direction
A Axial direction

The invention claimed is:

1. A jewelry clasp for securing a first end of an elongated member of a bracelet or a necklace to a second end of the elongated member, the jewelry clasp comprising:

a first clasp part and a second clasp part, wherein at least part of the first clasp part in an attached position thereof is positioned received in a housing of the second clasp part, at least one of the first and second clasp parts comprising a magnet and the other of the first and second parts comprising a part magnetically attractable by the magnet so that the first clasp part in its attached position is held to the second clasp part by magnetic attraction; and a slider attached atop and slideable along a longitudinal axis of the housing of the second clasp part, the slider being slideable between a releasing state and a locking state, the slider in the releasing state allowing for the first clasp part to be detached from the second clasp part, the slider in the locking state preventing the first clasp part from being detached from the second clasp part.

2. The jewelry clasp of claim 1, wherein the magnet is a first magnet, and the part magnetically attractable by the magnet is a second magnet.

3. The jewelry clasp of claim 1, wherein the magnet in the attached position of the first clasp part is held in abutment with the part magnetically attractable by the magnet.

4. The jewelry clasp of claim 1, wherein a head part of the first clasp part can be inserted into the housing through a radial opening of the housing, the radial opening in the locking state being at least partly covered by the slider, whereby the slider in the locking state prevents extraction of the inserted head part through the radial opening.

5. The jewelry clasp of claim 4, wherein the first clasp part further comprises a neck part, the neck part having reduced cross-sectional extent compared to the head part, and wherein the axial end of the housing comprises a cut-out connected to the radial opening so that, in the attached position of the first clasp part, the neck part is positioned in the cut-out, whereby the axial end surface surrounding the cut-out prevents the head part from moving in an axial direction.

6. The jewelry clasp of claim 1, wherein the slider slides between the releasing and locking states by means of at least one tongue sliding in at least one groove.

7. The jewelry clasp of claim 1, further comprising a snap lock which engages the slider and the housing when the slider is in the locking and/or in the releasing state so that a force in a sliding direction disengages the snap lock to allow the slider to slide to the other of the locking and/or releasing states, respectively.

8. The jewelry clasp of claim 7, wherein the snap lock includes a first snap lock part of the housing and a second snap lock part of the slider, and wherein the first snap lock part includes a spring-biased part which in the releasing and/or locking states is inserted into the second snap lock part taking the form of a depression of the slider.

9. The jewelry clasp of claim 8, wherein the spring-biased part comprises an attaching element, said attaching element comprising a base and at least one arm, said arm being configured to engage with the slider in the releasing and/or locking states.

10. The jewelry clasp of claim 9, wherein the slider comprises a cut-out, said cut-out extending between two opposed axial end walls, said end walls being plane and vertical, wherein each wall is configured to abut the arm of the attaching element to limit sliding movement of the slider beyond its releasing and locking states and prevent the spring-biased part from falling off.

11. The jewelry clasp of claim 8, wherein the spring-biased part comprises a circular surface, wherein the snap lock snaps by means of the circular surface.

12. The jewelry clasp of claim 1, wherein a magnet is positioned and held in a head part of the first clasp part.

13. The jewelry clasp of claim 1, wherein a magnet is positioned and held in a spacing in the housing.

14. The jewelry clasp of claim 1, wherein the magnet is positioned so that, in the attached position of the first clasp part, the magnetic attraction works in an axial direction of the clasp.

15. The jewelry clasp of claim 1, wherein the magnetic attraction assists in drawing the first clasp part into its attached position.

16. A piece of jewelry comprising an elongated member and a jewelry clasp according to claim 1, wherein the first clasp part is attached to or is one end of the elongated member, and the second clasp part is attached to or is the second end of the elongated member so that the clasp secures the first end to the second end when the first clasp part is in the attached position.

17. A method of closing the jewelry clasp of claim 1, comprising:

inserting at least part of the first clasp part within the housing so that the first clasp part is brought into its attached position; and sliding the slider from its releasing state to its locking state preventing the first clasp part from being detached from the second clasp part.

18. A method of opening the jewelry clasp of claim 1, comprising:

sliding the slider from its locking state to its releasing state to allow the first clasp part positioned in its attached position to be detached from the second clasp part; and exerting a force on the first clasp part to overcome the magnetic attraction and extract at least part of the first clasp part from the housing.

19. The jewelry clasp of claim 1, wherein the housing comprises a first opening and a second opening spaced apart from the first opening, and wherein the longitudinal axis of the housing passes through the first and second openings.

* * * * *